US006006632A

United States Patent [19]

Hsieh

[11] Patent Number: 6,006,632

[45] **Date of Patent: *Dec. 28, 1999**

[54] QUICK-RELEASE SOCKET ADAPTER FOR A RATCHET SOCKET WRENCH

[76] Inventor: Chih-Ching Hsieh, No. 64, Lane 107, Liang Tsun Rd., Fong Yuan City, Taichung Hsien, Taiwan

[ * ] Notice: This patent is subject to a terminal disclaimer.

[21] Appl. No.: 09/104,216

[22] Filed: Jun. 25, 1998

[51] Int. Cl.[6] ..... B25B 23/16

[52] U.S. Cl. ..... 81/177.85; 403/322; 81/177.2

[58] Field of Search ..... 81/177.2, 177.1, 81/177.85; 403/322, 324, 325, 328

[56] References Cited

U.S. PATENT DOCUMENTS 4,614,457 9/1986 Sammon ..... 403/322
4,962,682 10/1990 Rose et al. ..... 81/177.85
5,390,571 2/1995 Fox, III et al. ..... 81/177.85
5,531,140 7/1996 Chow ..... 81/177.85

*Primary Examiner*—James G. Smith
*Attorney, Agent, or Firm*—Varndell & Varndell, PLLC

[57] ABSTRACT

A quick-release socket adapter includes a hollow elongated casing having a front end for holding a socket and a rear end for coupling to a ratchet socket wrench, a spring, a stop rod inserted into the casing and forced by the spring to push a steel ball partially out of a transverse hole on the front end of the casing to lock the socket being mounted on the front end of the casing, and a release control rod inserted through a transverse through hole on the casing and moved to lock/unlock the stop rod, the release control rod having a smoothly curved peripheral notch on the middle which receives a rounded head of the stop rod, enabling the steel ball to be forced out of the transverse bole on the front end of the casing into engagement with the socket being mounted on the front end of the casing.

3 Claims, 12 Drawing Sheets

QUICK-RELEASE SOCKET ADAPTER FOR A RATCHET SOCKET WRENCH

BACKGROUND AND SUMMARY OF THE INVENTION

The present invention relates to a socket adapter for coupling a socket to a ratchet socket wrench, and more particularly to a quick-release socket adapter which enables the loaded socket to be quickly released.

A variety of ratchet socket wrenches have been disclosed for grasping and turning bolts, nuts, etc., and have appeared on the market. FIG. 1 shows a conventional ratchet socket wrench for this purpose. When in use, the socket is coupled to the polygonal driving shaft of the ratchet socket wrench and secured thereto by a steel on in a radial hole on the polygonal driving shaft. When not in use, the socket is directly removed from the polygonal driving shaft of the ratchet socket wrench by force. FIG. 2 shows another structure of conventional ratchet socket wrench. This structure of ratchet socket wrench has a release button controlled to release the steel ball from the socket being coupled to the polygonal driving shaft of the ratchet socket wrench. FIGS. 3 and 4 show two socket adapters used for coupling a socket to a ratchet socket wrench. These two socket adapters commonly have a polygonal front end for holding a socket, and a steel ball moved in and out of a radial hole on the polygonal front end to lock the socket mounted on the polygonal front end. When not in use, the user must employ much effort to remove the loaded socket from the polygonal front end of the adapter. FIGS. 5, 6 and 7 show a socket adapter which enables the user to dismount the loaded socket with less effort. This structure of socket adapter comprises a longitudinal hole, a radial hole perpendicularly extended from the longitudinal hole to the periphery of the polygonal front end thereof, a rear coupling end for coupling to a ratchet socket wrench, a steel ball moved in and out of the radial hole for locking socket being mounted on the polygonal front end, a transverse hole intersecting the longitudinal hole, a stop rod inserted into the longitudinal hole, the stop rod having hooked portion at one end and a sliding way adjacent to the hooked portion, a spring mounted inside the longitudinal hole and stopped against one end of the stop rod, and a release control rod inserted into the transverse hole, the release control rod having a retaining portion for engagement with the hooked portion of the stop rod. The spring imparts a forward pressure to the stop rod, causing the hooked portion of the stop rod to be engaged with the retaining portion of the release control rod. When engaged, the steel ball is partially forced out of the radial hole to lock the loaded socket. When the release control rod is depressed, the stop rod is forced backwards to compress the spring, and to release the steel ball from the loaded socket, enabling the loaded socket to be removed from the polygonal front end of the adapter. This structure of socket adapter still has drawbacks. Because the location of the release control rod is near the polygonal front end and far away from the rear coupling end of the adapter, the user just holds the ratchet socket wrench with one hand and operate the release control rod with the other hand when unlocking the loaded socket. Another drawback of this structure of socket adapter is its complicated structure. Because the procedure of processing the retaining portion on the release control rod and the hooked portion and sliding way on the stop rod is complicated, the manufacturing cost of this structure of socket adapter is high.

It is one object of the present invention to provide a quick-release socket adapter for coupling a socket to a ratchet socket wrench which enables the loaded socket to be quickly released from the socket adapter. It is another object of the present invention to provide a quick-release socket adapter which can be conveniently operated with one hand to release the loaded socket. It is still another object of the present invention to provide a quick-release socket adapter which is inexpensive to manufacture. To achieve these and other objects of the present invention, three is provided a socket adapter comprised of a hollow elongated casing, the casing having a cylindrical base, a polygonal front end at one end of the cylindrical base for holding a socket, and a coupling portion at an opposite end of the cylindrical base for coupling to a ratchet socket wrench, a spring mounted inside the coupling portion of the casing, a stop rod inserted into the casing and forced by the spring to push a steel ball partially out of a transverse hole on the polygonal front end of the casing to lock the socket being mounted on the polygonal front end of the casing, and a release control rod inserted through a transverse through hole on the coupling portion of the casing and moved to lock/unlock the stop rod, the release control rod having a smoothly curved peripheral notch on the middle which receives a rounded head of the stop rod, enabling the steel ball to be forced out of the transverse hole on the polygonal front end of the casing into engagement with the socket being mounted on the polygonal front end of the casing.

DETAILED DESCRIPTION OF THE PREFERRED EMBODIMENT

Figure 1:
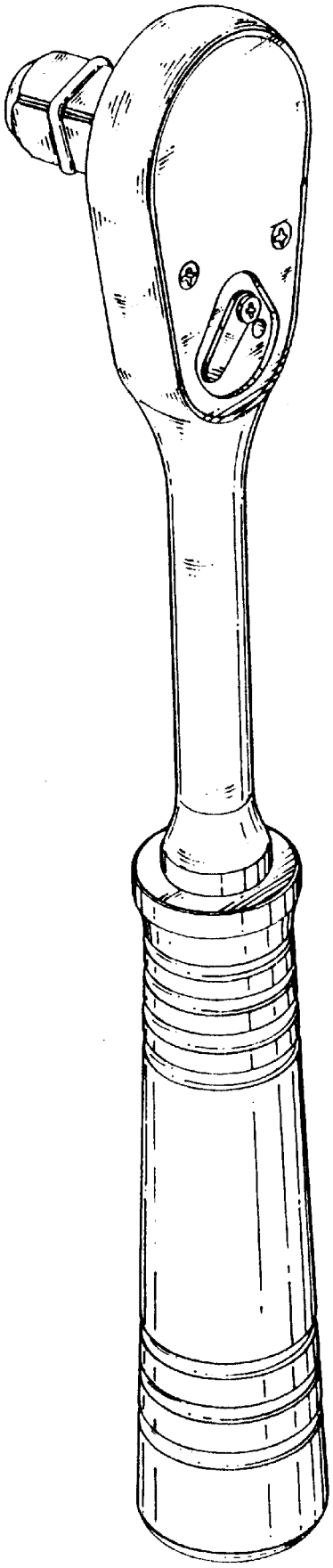
Fig . 1 PRIOR ART
FIG. 1 is a perspective view of a conventional ratchet socket wrench.
Figure 2:
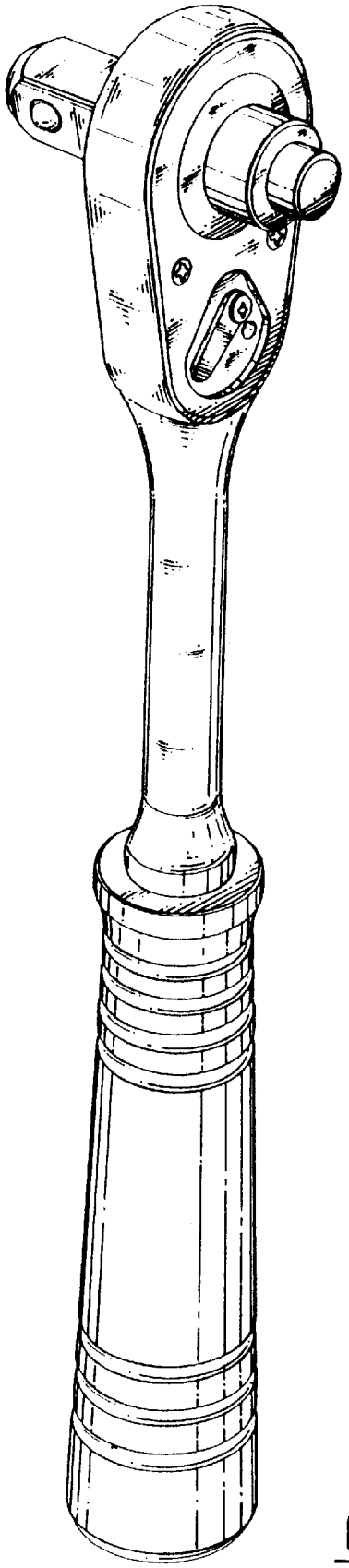
Fig. 2 PRIOR ART
FIG. 2 is a perspective view of another structure of conventional ratchet socket wrench.
Figure 3:
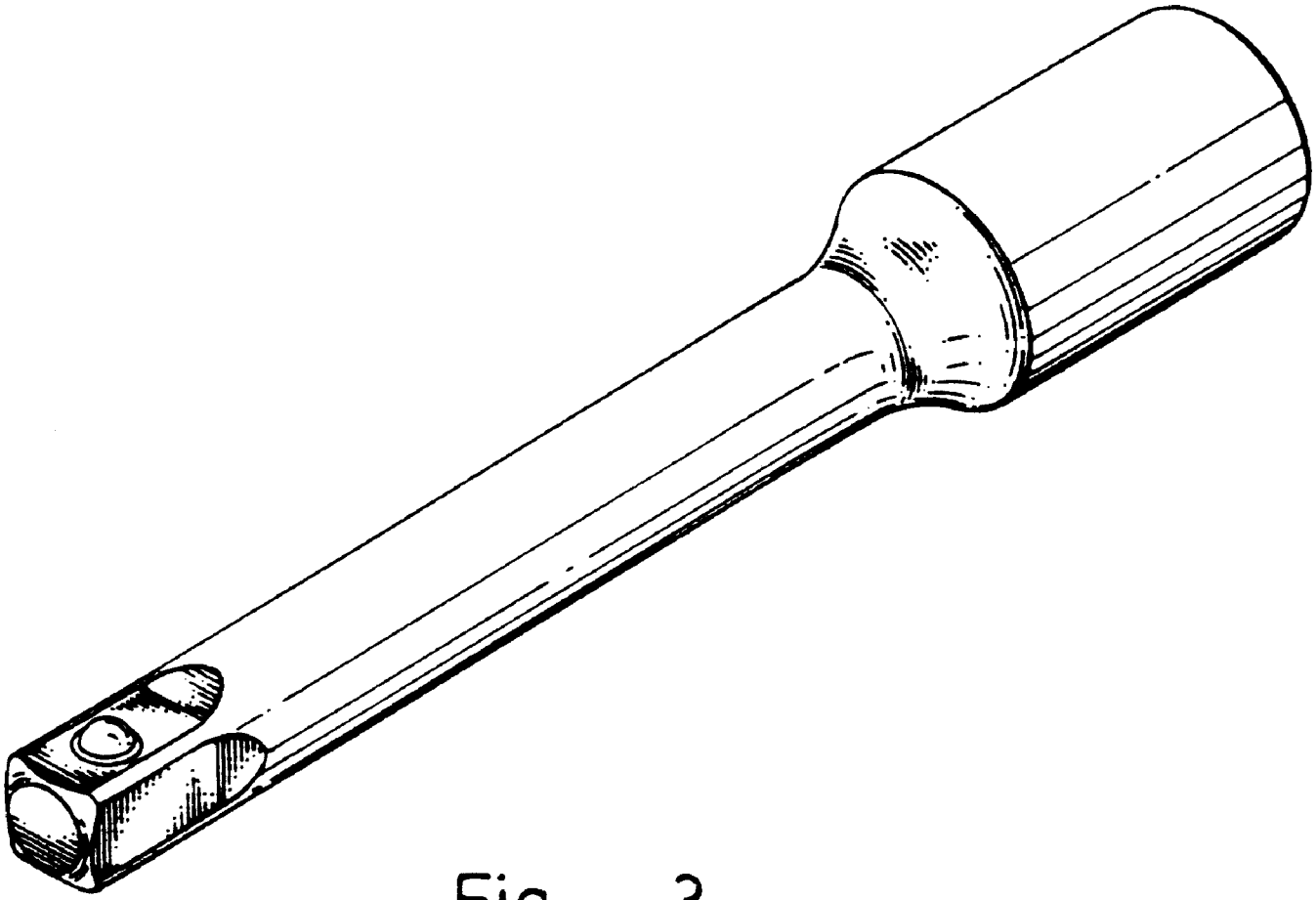
Fig. 3 PRIOR ART
FIG. 3 is a perspective view of a socket adapter for a ratchet socket wrench according to the prior art.
Figure 4:
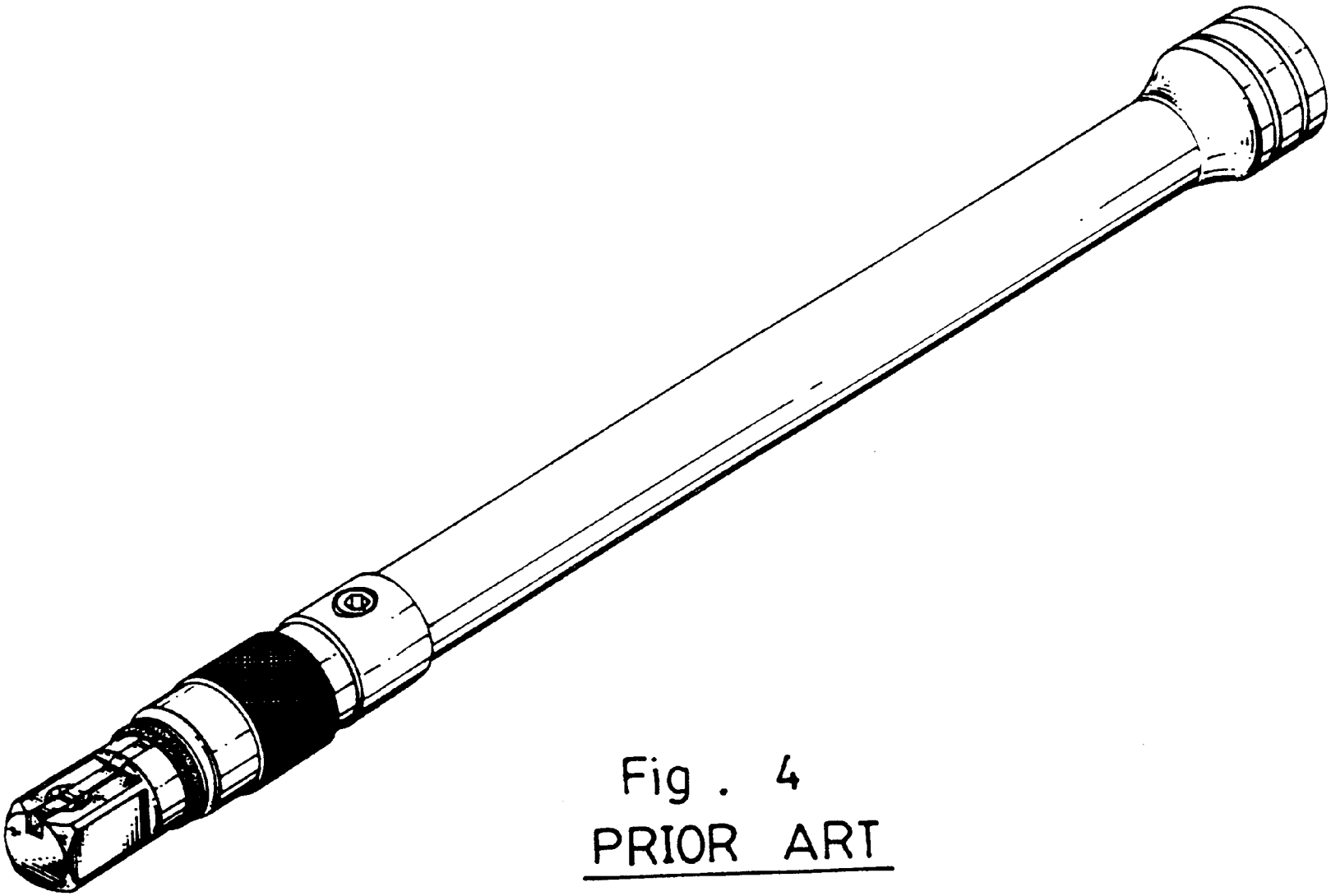
Fig. 4 PRIOR ART
FIG. 4 is a perspective view of another socket adapter for a ratchet socket wrench according to the prior art.
Figure 5:
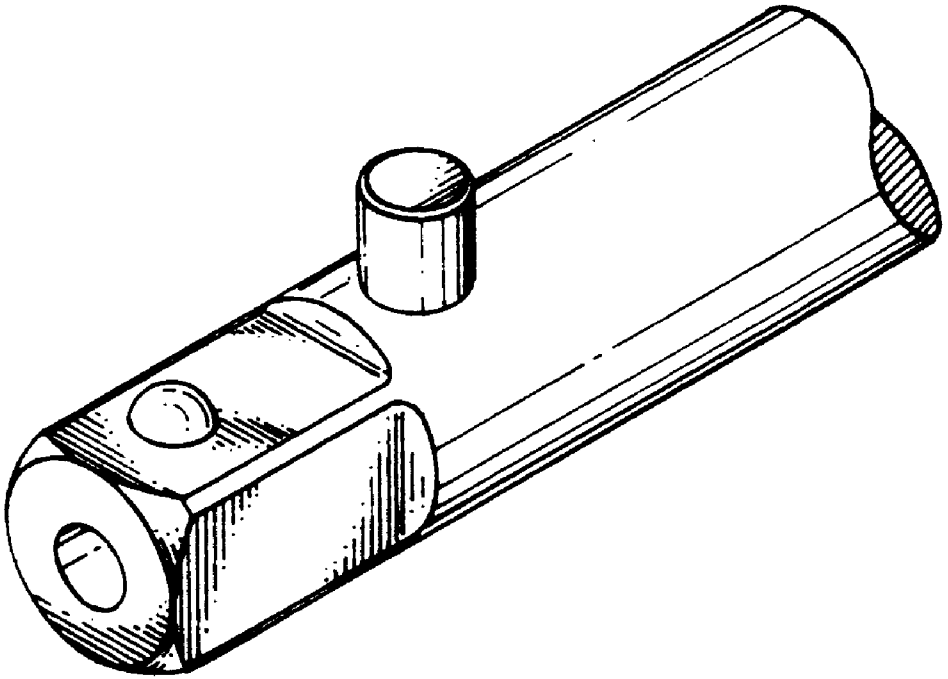
Fig. 5 PRIOR ART
FIG. 5 is a perspective view of still another socket adapter for a ratchet socket wrench according to the prior art.
Figure 6:
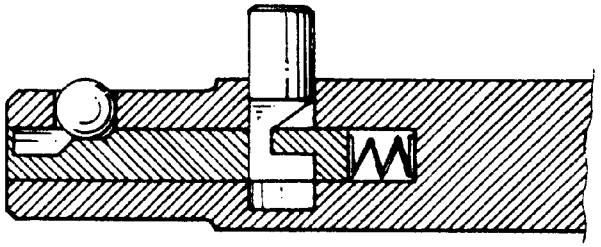
Fig. 6 PRIOR ART
FIG. 6 is a sectional view of FIG. 5.
Figure 7:
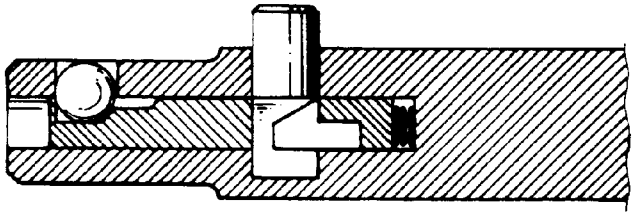
Fig. 7 PRIOR ART
FIG. 7 is similar to FIG. 6 but showing the release control rod depressed, the steel ball received in the radial hole on the polygonal front end of the adapter.
Figure 8:
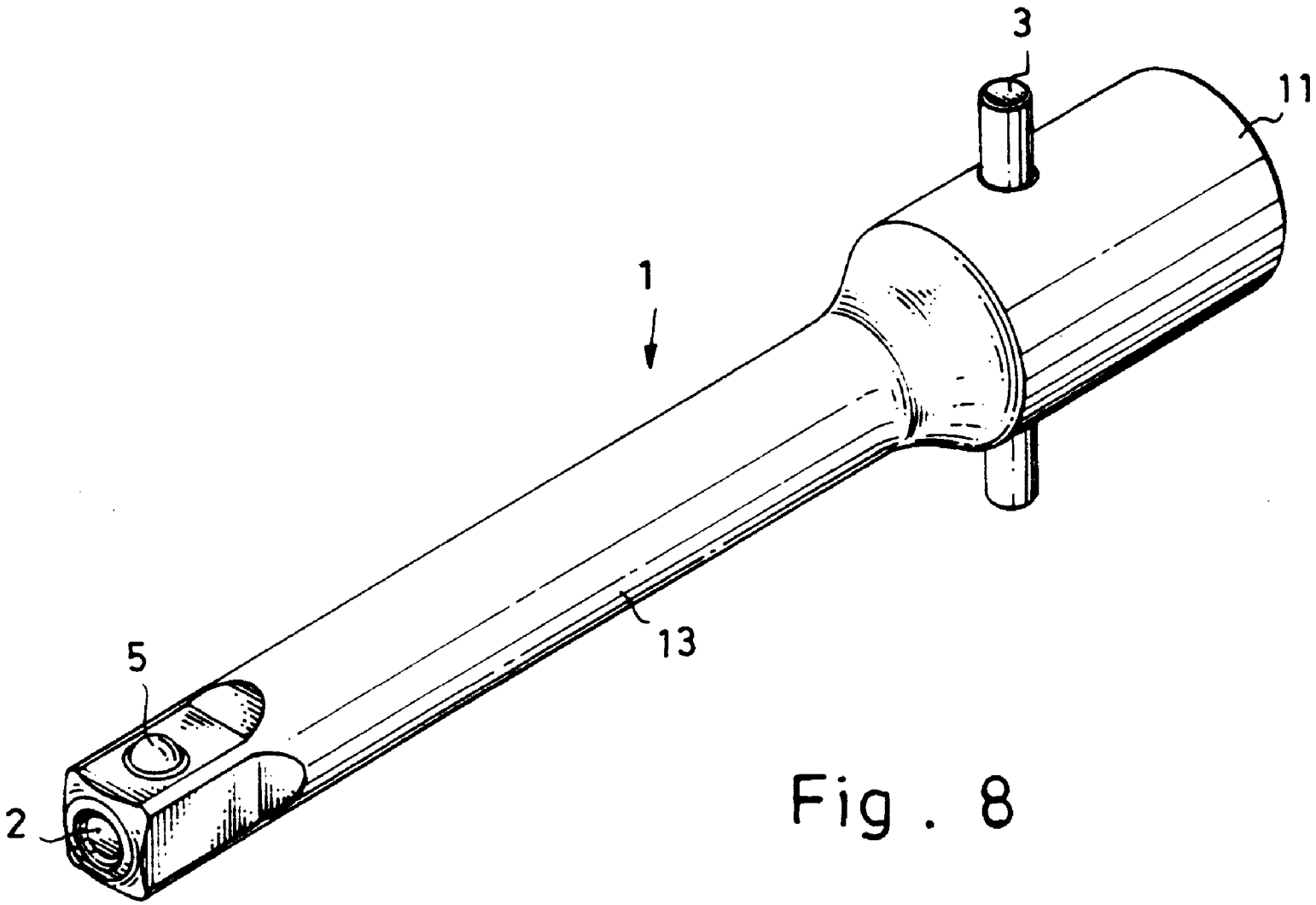
FIG. 8 is a perspective view of a quick-release socket adapter for a ratchet socket wrench according to one embodiment of the present invention.
Figure 9:
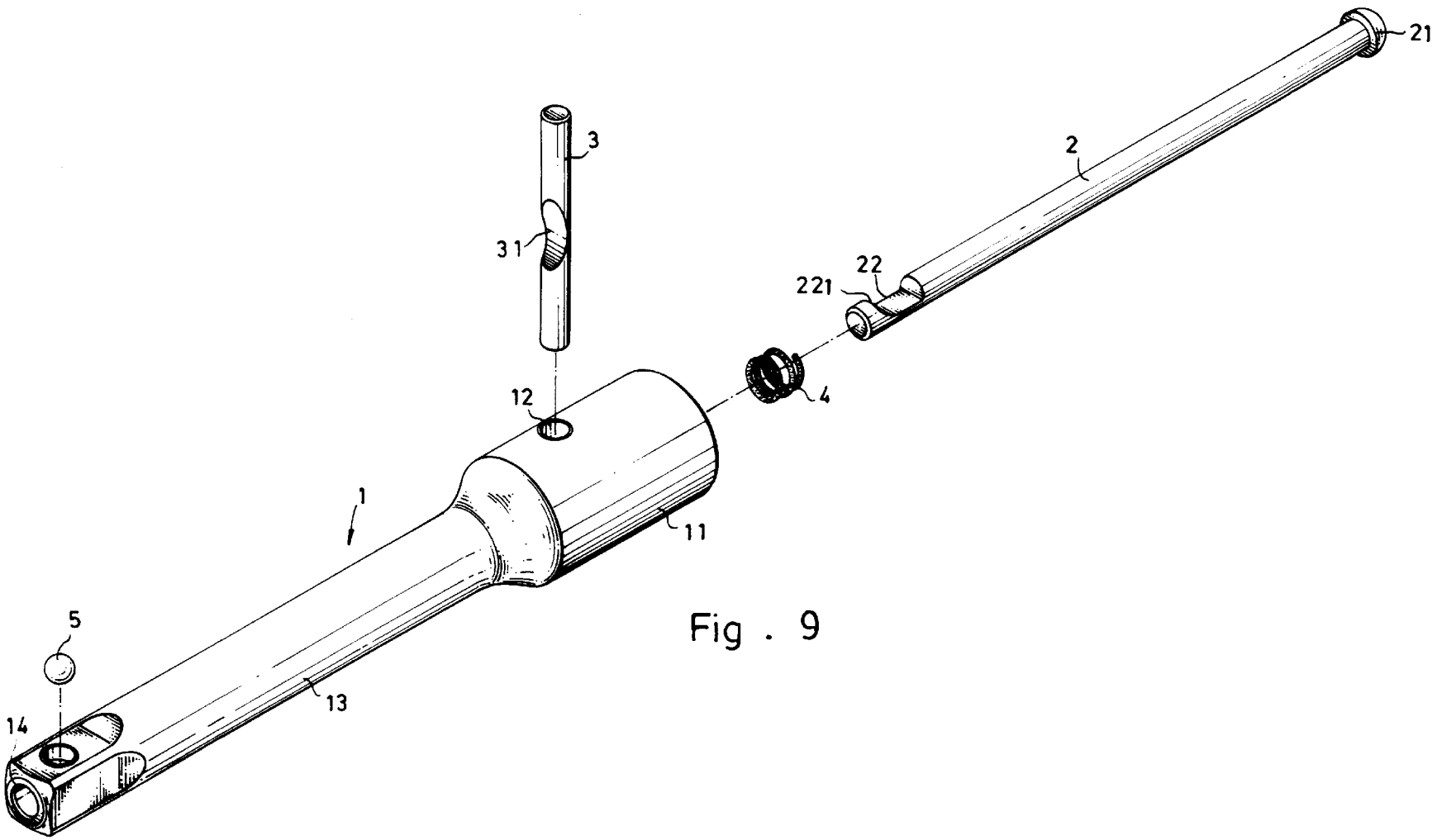
FIG. 9. is an exploded view of the quick-release socket adapter shown in FIG. 8.
Figure 10:
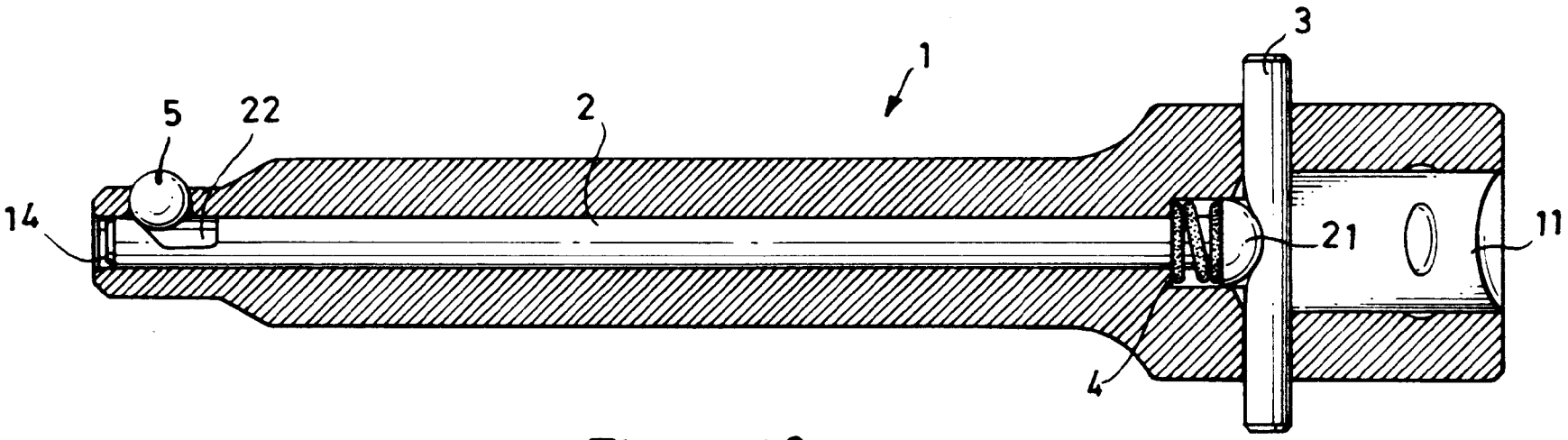
FIG. 10 is a longitudinal view in section of FIG. 8.

Referring to Figures from 8 to 10, a quick-release socket adapter in accordance with the present invention is generally comprised of an elongated casing 1, a stop rod 2, a release control rod 3, a spring 4, and a steel ball 5.

The elongated casing 1 comprises a cylindrical base 13 which has polygonal for example square front end for holding a socket and a rear end, a cylindrical ratchet socket wrench coupling portion 11 integral with the rear end of the cylindrical base 13 for coupling to a ratchet socket wrench, a transverse through hole 12 transversely pierced through the hollow cylindrical ratchet socket wrench coupling portion 11 which receives the release control rod 3, a longitudinal through hole 14 longitudinally pierced through the longitudinal central axis of the cylindrical base 13 in communication with the inside space of the hollow cylindrical ratchet socket wrench coupling portion 11 which receives the stop rod 2, and a locating hole 15 perpendicularly extended from the longitudinal through hole 14 to the periphery of the square front end of the cylindrical base 13 which receives the steel ball 5.

The stop rod 2 is inserted into the longitudinal through hole 14 of the elongated casing 1, having a rounded head 21 at one end which is inserted into the inside space of the hollow cylindrical ratchet socket wrench coupling portion 11, and a peripheral notch 22 at one end which receives a part of the steel ball 5 and has a sloping working edge 221 at one end.

The release control rod 3 is a round rod inserted through the transverse through hole 12 on the hollow cylindrical ratchet socket wrench coupling portion 11 of the elongated casing 1, having a smoothly curved peripheral notch 31 on the middle which receives the rounded head 21 of the stop rod 2.

The spring 4 is mounted around the stop rod 2, and stopped between the rounded head 21 of the stop rod 2 and an inside edge inside the hollow cylindrical ratchet socket wrench coupling portion 11 of the elongated casing 1. When installed, the spring 4 imparts an outward pressure to the rounded head 21 of the stop rod 2, causing the rounded head 21 to be forced into engagement with the smoothly curved peripheral notch 31 of the release control rod 3.

The steel ball 5 is mounted in the locating hole 15, and forced by the stop rod 2 to project partially out of the outside wall of the square front end of the cylindrical base 13 of the elongated casing 1.

Figure 11:
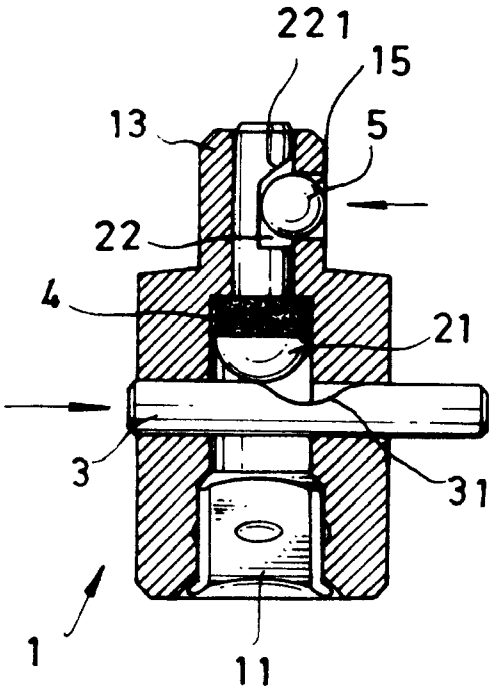
FIG. 11 is a sectional view of an alternate form of the present invention, showing peripheral notch of the release control rod disengaged from the rounded head of the stop rod, the steel ball received in the smoothly curved peripheral notch of the stop rod.
Figure 12:
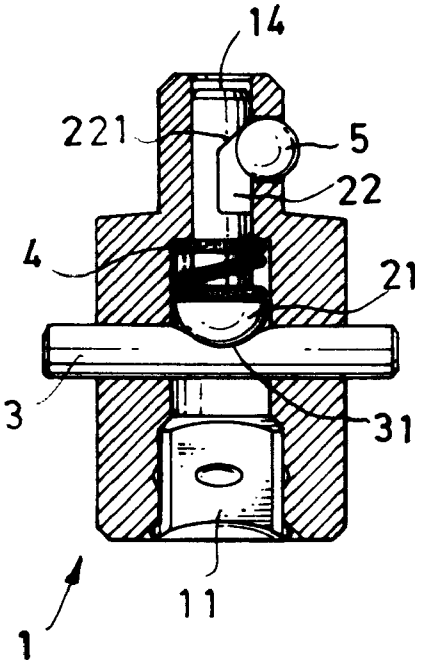
FIG. 12 is similar to FIG. 11 but showing the peripheral notch of the release control rod engaged with the rounded head of the stop rod, the steel ball forced out of the transverse locating hole on the polygonal front end of the casing.

FIGS. 11 and 12 show an alternate form of the present invention in which the cylindrical base 13 is relatively shortened. The operation of the embodiment shown in Figures from 8 to 10 is same as that shown in FIGS. 11 and 12. When a socket is sleeved onto the square front end of the cylindrical base 13 of the elongated casing 1, the steel ball 5 is forced inwards in the locating hole 15, enabling the socket to be coupled to the square front end of the cylindrical base 13. When the steel ball 5 is forced inwards, it imparts a downward pressure to the sloping working edge 221 of the peripheral notch 22 of the stop rod 2, thereby causing the stop rod 2 to be forced forwards. When the stop rod 2 is forced forwards, the spring 4 is compressed by the rounded head 21 of the stop rod 2. After the socket has been set into position and released from the hand, the stop rod 2 is pushed back by the spring power of the spring 4, and the steel ball 5 is partially forced out of the locating hole 15 into engagement with the loaded socket , causing the loaded socket to be firmly secured to the square front end of the cylindrical base 13 of the elongated casing 1. When disconnecting the socket from the square front end of the cylindrical base 13 of the elongated casing 1, the release control rod 3 is pushed with the hand in one direction to disengage the smoothly curved peripheral notch 31 from the rounded head 21 of the stop rod 2, causing the stop rod 2 to be forced forwards by the periphery of the release control rod 3, and therefore the spring 4 is compressed by the rounded head 21 of the stop rod 2, and at the same time the steel ball 5 is lowered along the sloping working edge 221 to the bottom of the peripheral notch 22 of the stop rod 2 and released from the loaded socket (see FIG. 11), enabling the loaded socket to be freely removed from the square front end of the cylindrical base 13 of the elongated casing 1.

Figure 13:
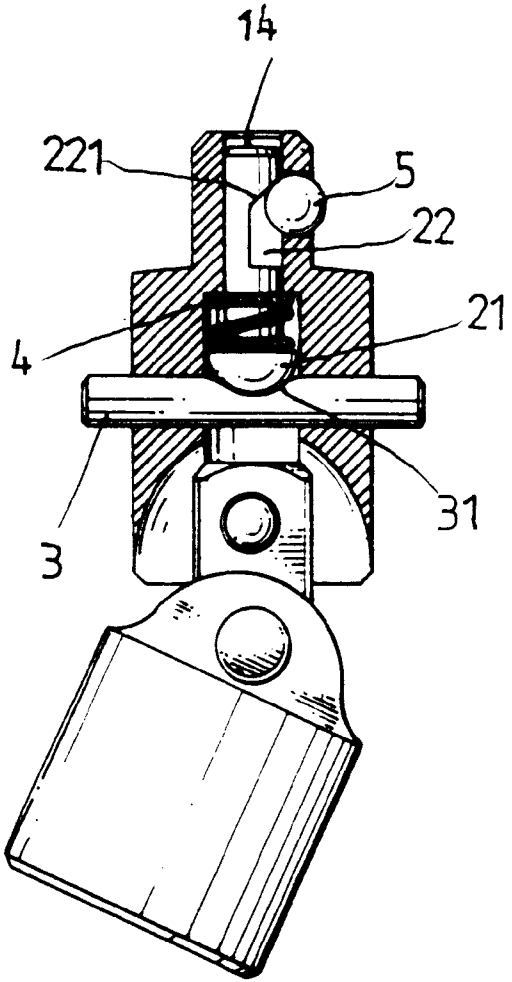
FIG. 13 shows the present invention used in an universal connector.
Figure 14:
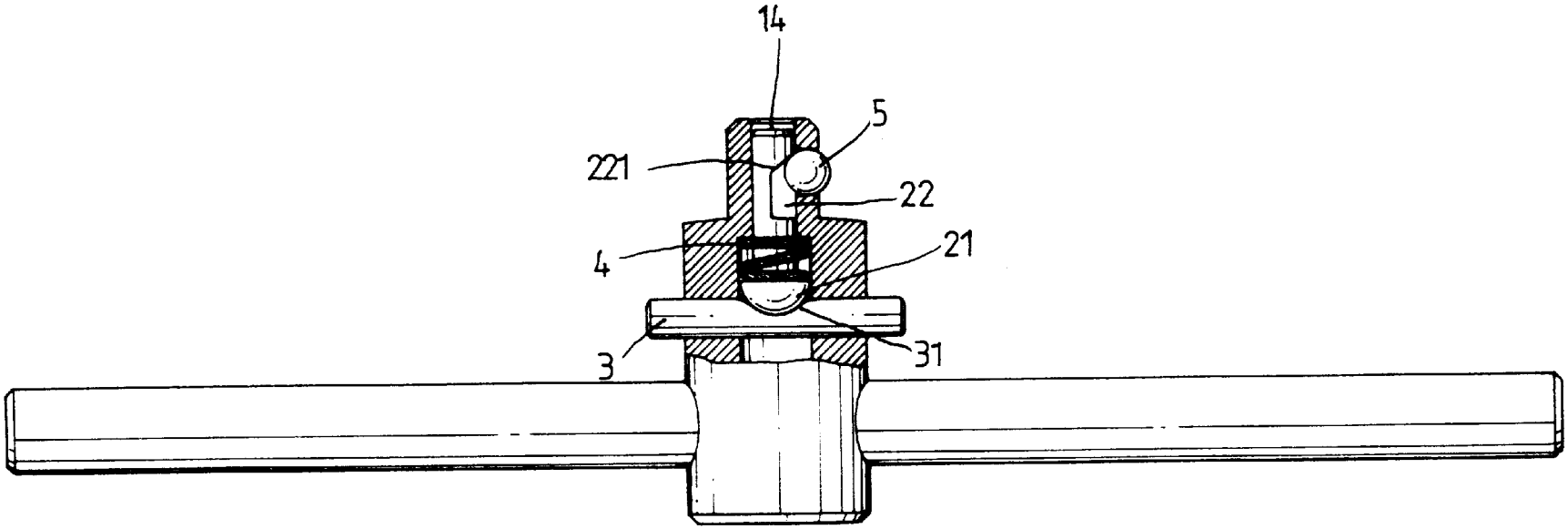
FIG. 14 shows another application example of the present invention.

It is to be understood that the drawings are designed for purposes of illustration only, and are not intended as a definition of the limits and scope of the invention disclosed. For example, the quick-release socket adapter can be integral with an universal connector as shown in FIG. 13, or a spanner as shown in FIG. 14.

I claim:

1. A quick-release socket adapter comprising:

a hollow elongated casing having a cylindrical base, a polygonal front end at one end of said cylindrical base for holding a socket, a hollow ratchet socket wrench coupling portion at an opposite end of said cylindrical base remote from said polygonal front end for coupling to a ratchet socket wrench, a first transverse hole on said polygonal front end, and a second transverse hole on said ratchet socket wrench coupling portion;

a steel ball moved in and out of the first transverse hole on said polygonal front end of said casing;

a stop rod inserted into said casing and moved between a first position where said steel ball is partially forced out of said first transverse hole by said stop rod to secure a socket to said polygonal front end of said casing, and a second position where said steel ball is received inside said first transverse hole to release the socket being coupled to said polygonal front end of said casing, said stop rod having a smoothly curved periphery notch near a front end thereof for receiving said steel ball, said smoothly curved peripheral notch having a sloping working edge at one end;

spring means imparting a pressure to said stop rod to move said stop rod to said first position; and a release control rod mounted in said second transverse hole on said casing and operated to move said stop rod to said second position;

wherein said stop rod has a head at one end remote from the smoothly curved peripheral notch of said stop rod; said spring means is mounted around said stop rod and stopped between the head of said stop rod and an inside edge of said casing between said polygonal front end and said ratchet socket wrench coupling portion; said release control rod is inserted through said second transverse hole on said casing to stop said stop rod in said first position, said release control rod having two opposite ends respectively extended out of the periphery of said ratchet socket wrench coupling portion in reversed directions for moving by hand to release said stop rod.

2. The quick-release socket adapter of claim 1 wherein said release control rod has a smoothly curved notch on a middle thereof for receiving the head of said stop rod, enabling said stop rod to be moved to said first position by said spring means.

3. The quick-release socket adapter of claim 1 wherein the head of said stop rod is a rounded head.

* * * * *